US009903693B2

(12) United States Patent
Salvino et al.

(10) Patent No.: US 9,903,693 B2
(45) Date of Patent: Feb. 27, 2018

(54) BROADHEAD WITH EXTENDABLE BLADES

(71) Applicants: Nevin Salvino, Villa Park, IL (US); Cameron Salvino, Villa Park, IL (US)

(72) Inventors: Nevin Salvino, Villa Park, IL (US); Cameron Salvino, Villa Park, IL (US)

( * ) Notice: Subject to any disclaimer, the term of this patent is extended or adjusted under 35 U.S.C. 154(b) by 50 days.

(21) Appl. No.: 13/731,655

(22) Filed: Dec. 31, 2012

(65) Prior Publication Data

US 2016/0047637 A1 Feb. 18, 2016

Related U.S. Application Data

(60) Provisional application No. 61/584,797, filed on Jan. 9, 2012, provisional application No. 61/582,363, filed on Jan. 1, 2012.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | | |
|---|---|---|---|---|---|
| 5,458,341 | A * | 10/1995 | Forrest | F42B 6/08 | 473/583 |
| 5,564,713 | A * | 10/1996 | Mizek | F42B 6/08 | 473/583 |
| 5,803,844 | A * | 9/1998 | Anderson | F42B 6/08 | 473/583 |
| 6,517,454 | B2 * | 2/2003 | Barrie | F42B 6/08 | 473/583 |
| 7,377,869 | B2 * | 5/2008 | Wohlfeil | F42B 6/08 | 473/583 |
| 7,771,298 | B2 * | 8/2010 | Pulkrabek | F42B 6/08 | 473/583 |
| 8,398,510 | B1 * | 3/2013 | Mizek | F42B 6/08 | 473/583 |
| 2012/0040787 | A1 * | 2/2012 | Ulmer | F42B 6/08 | 473/583 |

* cited by examiner

*Primary Examiner* — John Ricci
(74) *Attorney, Agent, or Firm* — Michael Ries

(57) ABSTRACT

A broadhead arrowhead has blades that deploy when the arrowhead penetrates a target. The blades extend after the arrowhead has penetrated the target a sufficient distance for a lead edge of the blade to contact the wound made in the target. Before and during flight the extendable blades are held in a retracted position by frictional engagement with a retaining element that remains attached to the arrowhead. The configuration of the extendable blades provides a stable profile when the arrowhead is in flight.

11 Claims, 9 Drawing Sheets

BROADHEAD WITH EXTENDABLE BLADES

This application claims priority from U.S. patent application Ser. No. 61/584,797, filed Jan. 9, 2012, entitled "Broadhead With Extendable Blades" which is a continuation-in-part of and claims priority from U.S. patent application Ser. No. 61/582,363, filed Jan. 1, 2012, entitled "Broadhead With Extendable Blades," both of which are incorporated herein by reference in their entireties.

FIELD OF THE INVENTION

This invention relates generally to arrowheads and, more specifically, to a type of arrowhead referred to as a broadhead, having an arrow tip and blades that are tucked in during flight and are deployed when the arrow strikes its target.

BACKGROUND OF THE INVENTION

Broadhead arrowheads are well known in the bow hunting art. In particular, broadheads having auxiliary blades that deploy when the arrow strikes its target are also well known, and will be referred to generally as expanding or expandable broadheads.

Expandable broadheads allow an arrowhead to have a relatively small and streamlined configuration during flight to enhance accuracy. Upon striking a target, a set of auxiliary blades expand for the purpose of enlarging the entrance wound, enabling a more certain and humane kill.

U.S. Pat. No. 6,517,454 (Barrie et al) discloses a broadhead with sliding, expanding blades. The blades are pivotally attached to the arrowhead and are held closed in flight by a rubber restraint. When the arrowhead penetrates the target, the forward edges of the blades also contact the target forcing the blades rearward, severing the restraint and allowing the trailing edges of the blades to dispose outward to a V-shape thereby exposing the sharpened edges of the blades.

Published U.S. Patent Application 2009/0029811 (Bolen III) discloses an expandable broadhead and blades therefor. In Bolen, the auxiliary blades face forward with the pivots for them positioned at the rear of the arrowhead. The blades are configured to fracture if, when they expand and strike the target, they encounter a hard or solid object, such as a bone.

U.S. Pat. No. 6,554,727 (Armstrong et al) discloses a deflection-resistant arrowhead having both fixed and mechanically expandable blades. In Armstrong, the blades have a rearward pivot and face forward, and are held in place by a severable restraint during flight. When the arrowhead strikes the target, a forward edge of each expandable blade also contacts the target forcing the blades rearward around the pivot to open and thus expose the sharpened edges of the blades.

U.S. Pat. No. 6,595,881 (Grace Jr.) discloses an expanding blade-archery broadhead with the blades, in their stored position, facing forward and having a rear or trailing pivot. A sliding collar deploys forward when the arrowhead strikes its target causing the blades to extend and pivot rearward, exposing the sharpened blade edges.

U.S. Pat. No. 6,669,586 (Barrie et al) discloses an expanding broadhead having expandable blades with forward pivots attached to a collar that is slidably mounted within the arrowhead body. When the arrowhead strikes the target, the mounting ring is brought into contact with a camming surface within the arrowhead which deploys the sharpened edges of the blades by severing the restraint.

U.S. Pat. No. 6,910,979 (Barrie et al) discloses an expandable broadhead with expandable blades having arcuate slots formed thereon. The blades are mounted to the arrowhead with a guide boss positioned within the slot. When the arrowhead penetrates the target, the lead edge of each blade comes into contact with the target of the blade is forced along the arcuate slot to deploy with the sharpened blade edges exposed.

U.S. Pat. No. 7,226,375 (Sanford) discloses an expandable arrow broadhead for attachment to one end of an arrow shaft. A set of rearward extending blades, pivoted at their front end are attached to an arrowhead and are held in place by a rubber band. When the arrow strikes its target, a collar within the arrowhead slides forward contacting the blades forcing them outward with sufficient force to sever the rubber band and deploy the sharpened cutting edges.

The foregoing references are incorporated herein in their entirety.

SUMMARY OF THE INVENTION

It is an object of the present invention to provide an arrowhead with expandable blades which, in their unextended position, provide an arrowhead profile that is configured to be accurate in flight.

It is a further object of the present invention to retain the expandable blades during flight without requiring the use of a retaining member.

It is a further object of the present invention to provide blades that are of greater length than those normally associated with expandable broadheads.

It is a further object of the present invention to provide a mechanism that quickly, reliably and accurately deploys the blades to a cutting position in a minimum amount of time.

It is a further object of the present invention to provide these blades in cross-configurations such that the actuating surface and cutting surface of each blade deploy on opposite sides of the arrowhead.

While the following describes a preferred embodiment or embodiments of the present invention, it is to be understood that this description is made by way of example only and is not intended to limit the scope of the present invention. It is expected that alterations and further modifications, as well as other and further applications of the principles of the present invention will occur to others skilled in the art to which the invention relates and, while differing from the foregoing, remain within the spirit and scope of the invention as herein described and claimed. Where means-plus-function clauses are used in the claims such language is intended to cover the structures described herein as performing the recited functions and not only structural equivalents but equivalent structures as well. For the purposes of the present disclosure, two structures that perform the same function within an environment described above may be equivalent structures.

BRIEF DESCRIPTION OF THE DRAWINGS

These and further objects of the present invention will be best understood upon consideration of the accompanying drawings in which.

DETAILED DESCRIPTION OF THE DRAWINGS

Figure 1:
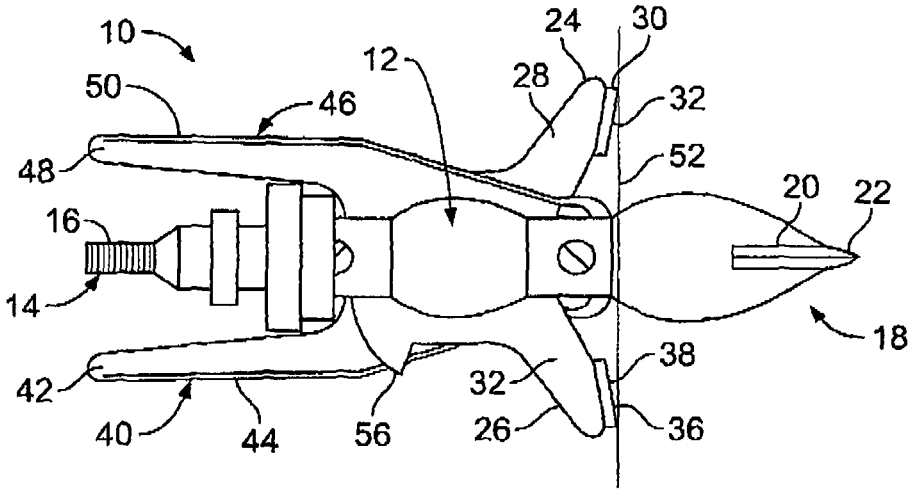
FIG. 1 is a top plan view of a broadhead arrow after penetration of a target, but prior to the deployment of the blades.

Referring now to FIG. 1, the numeral 10 indicates generally a broadhead arrowhead referred to throughout as "a broadhead." Broadhead 10 has a proximal end 14 to which a threaded shaft 16 is formed. Shaft 16 is used to thread broadhead 10 onto an arrow shaft. Body 12 has a distal end 18 at which a blade mount 20 is formed as a site for the attachment of tip blade 22. In the embodiment shown, broadhead 10 has a left expandable blade 24 and a right expandable blade 26 pivotally attached to body 12. As seen in FIG. 1, left blade 24 has a lead segment 28 terminating at a lead edge 30 to which an impact bar 32 is attached.

In like fashion, right blade 26 has a lead segment 34 terminating at a lead edge 36 to which an impact bar 38 is attached.

Left blade 24 has a trailing blade segment 40 having a planar leg 42 along with a sharpened edge 44 is formed. In this embodiment, sharpened edge 44 is formed outboard of or in a direction away from body 12.

In like fashion, blade 26 has a rear trailing segment 46 having a planar arm 48 on which is formed a sharpened edge 50. As with sharpened edge 44, sharpened edge 50 is formed outboard or in a direction away from body 12.

As seen in FIG. 1, broadhead 10 is shown as having made contact with and penetrating target 52. As seen in FIG. 1, arms 24 and 26 are in their closed or in-flight position. In this position, blades 24, 26, present a balanced configuration that contributes to the stability and accuracy of an arrow's flight with broadhead 10 attached thereto.

Figure 2:
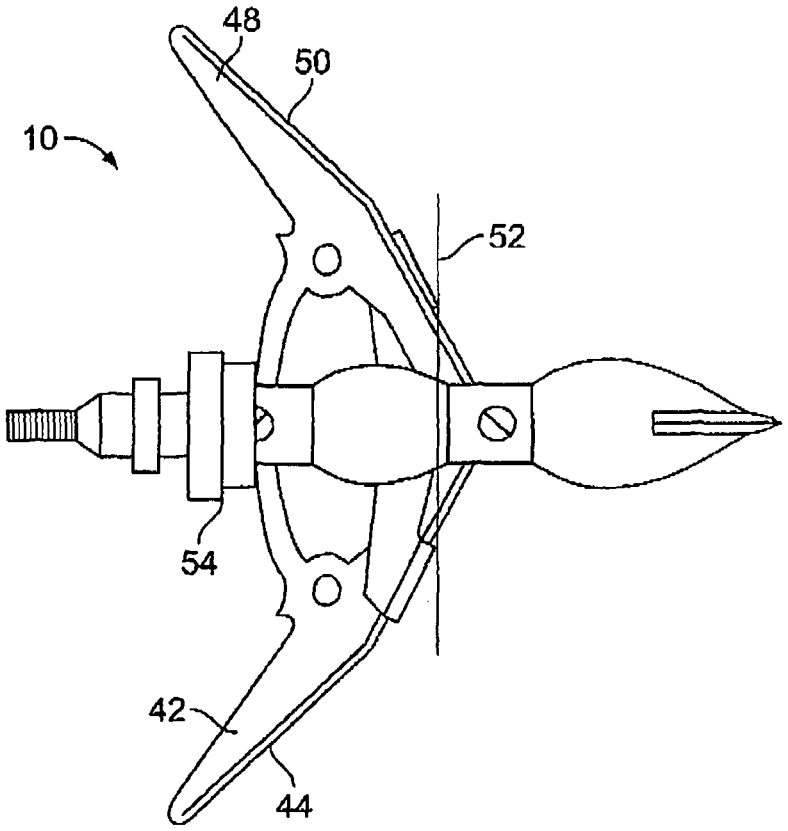
FIG. 2 is the broadhead arrow of FIG. 1 after the blades have been deployed.

Referring to FIG. 2, broadhead 10 is shown having penetrated target 52 to a distance sufficient to put impact bars 32, 38 into contact with target 52 to deploy left and right trailing blade segments 42, 48 and, thereby, sharpened edges 42, 50. In this position, broadhead 10 will continue its travel into target 52 to engage sharpened edges 44, 50, thereby increasing the size of the impact zone.

As seen in FIG. 2, body 12 has a rubber o-ring 54 mounted thereto to act as a retainer for blades 24, 26 in their closed position and to act as stop and to absorb the impact created when blades 24, 26 deploy. As seen in FIG. 1, right blade 26 has a brace edge 56 formed at the rear of right lead segment 34. As will be described hereinbelow, as right blade 26 pivots to deploy trailing segment 48, stop segment 56 will move toward and contact shock absorber 54. It should be understood that a similar lock edge is formed on left blade 24. Shock absorber 54 may be formed from a heavy rubber or otherwise flexible material and is held in place on body 12 by retainer 58. Shock absorber 54 not only damps the rearward motion of blades 24, 26, it also provides a stop to lock the blades in their deployed position such that contact between sharpened edges 44, 50 and target 52 does not cause trailing arms 42, 48 to move or otherwise collapse.

Figure 3:
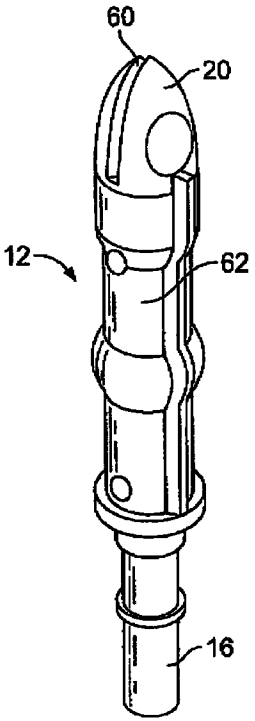
FIG. 3 is a perspective view of the ferrule of FIG. 1.

Referring now to FIG. 3, a perspective view of body 12 is shown. Blade mount 20 has a arrow tip blade mount slot 60 formed therethrough, partially along body 12. A centrally positioned blade mount slot 62 is also formed in body 12. Also shown in FIG. 3 is threaded shaft 16 used to mount body 12 to an arrow shaft.

Figure 4:
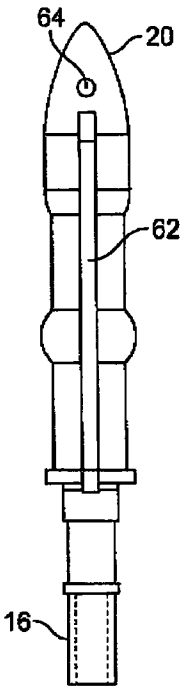
FIG. 4 is front elevation of the ferrule of FIG. 3.

Referring now to FIG. 4, blade mount slot 62 is more clearly shown. Also as seen in FIG. 4, arrow tip blade mount 20 has a mounting aperture 64 through which a fastener can be passed to secure an arrow tip in place.

Figure 5:
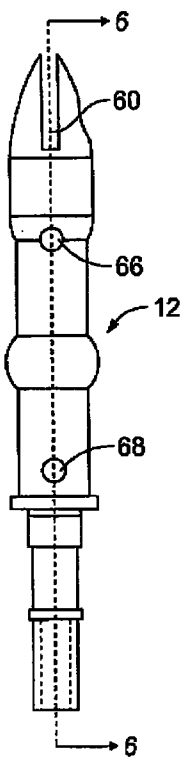
FIG. 5 is a side elevation of the ferrule of FIG. 3.

Referring now to FIG. 5, a lateral view of body 12 is shown with arrow tip blade mount slot 60 shown in greater detail. Also shown are upper blade mount bore 66 and blade lock bore 68. As will be shown hereafter, bore 66 allows a fastener to be inserted into body 12 to retain left blade 24 and right blade 26.

Figure 6:
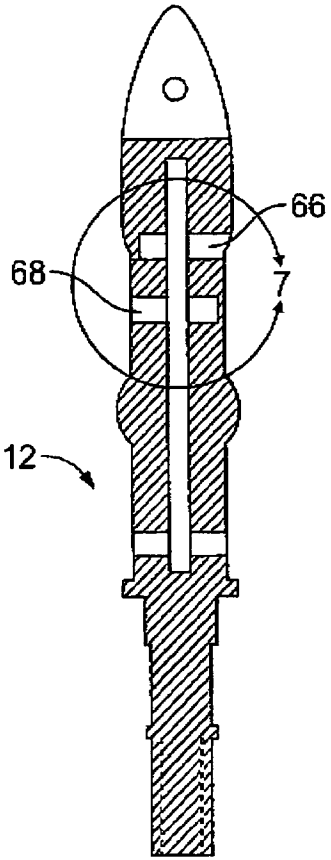
FIG. 6 is a view along D-D of FIG. 5.

Referring now to FIG. 6, a sectional view taken along lines 6-6 of FIG. 5 shows bore 66 is preferably formed as a blind bore into which a fastener may be inserted and attached. In like fashion, bore 68 is also formed as a blind bore. Preferably bores 64 and 68 are positioned on opposite sides of body 12.

Figure 7:
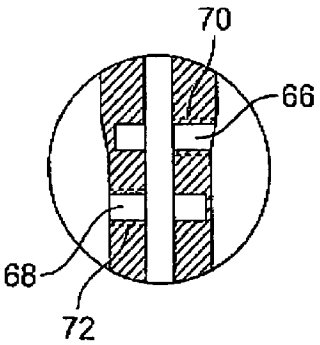
FIG. 7 is an enlargement of detail A in FIG. 6.

Referring now to FIG. 7, an enlarged view of detail A of FIG. 6 is shown wherein it can seen that the lead portion 70 of bore 66 is internally threaded as is the lead portion 72 of bore 68. These threaded portions provide the means by which fasteners such as that shown in FIGS. 21 and 22 may be threaded into bores 66, 68 and retained in position. This configuration provides a more symmetrical distribution of mass when broadhead 10 is assembled, enhancing accurate and predictable flight.

Figure 8:
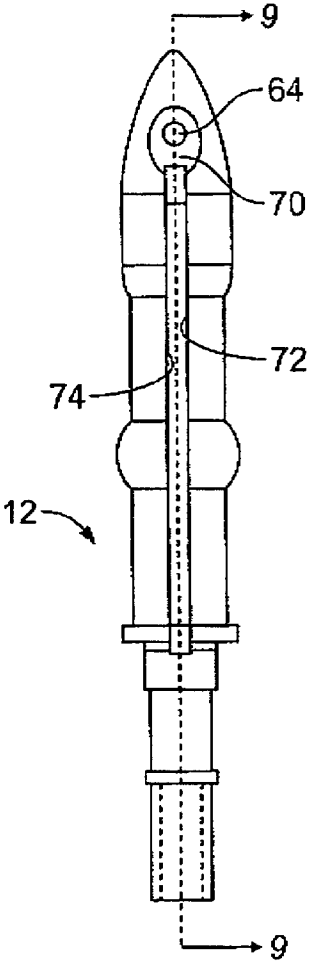
FIG. 8 is a bottom view of the ferrule of FIG. 3.

Referring now to FIG. 8, a lateral elevation of body 12 is shown, demonstrating blade tip mount slot aperture 64. In this embodiment blade mount 20 has a countersink 70 to receive the head of a fastener screwed into aperture 64, thus improving the aerodynamic quality of body 12.

Figure 9:
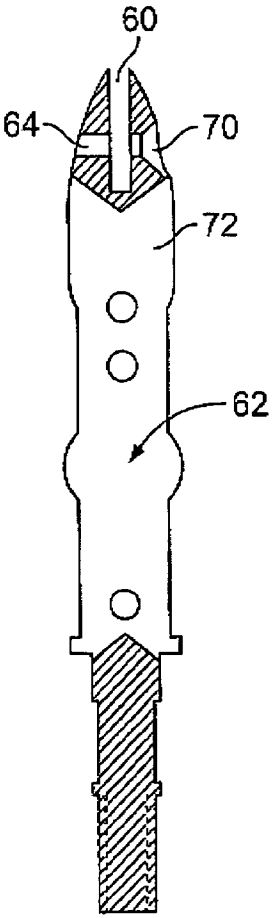
FIG. 9 is a view along 9-9 of FIG. 8.

Referring now to FIG. 9, a view along 9-9 of FIG. 8, it can be seen that the interior of blade mount slot 62 has a flat, smooth, machined surface 72.

It is a feature of the present invention that blades 24, 26 will be attached to body 12 in a stacked configuration, that is, with the blades touching one another. It is also a feature that the outermost surface of each blade will be in contact with machined surface 72 and flat machined surface 74 formed on the opposite side of slot 62, as seen in FIG. 8. Machining both the blade surfaces and the slot surfaces decreases the friction realized when blades 24, 26 move not only with relation to each other but with relation to inner surfaces 72, 74 of body 12.

Figure 10:
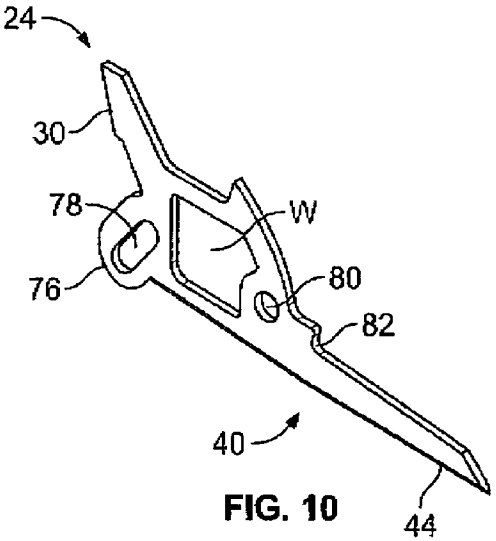
FIG. 10 is a perspective view of a broadhead blade

Referring now to FIG. 10, the numeral 24 identifies the left blade showing the left lead segment 28, left lead edge 30, the left trailing segment 40, the left trailing arm 42 and the sharpened edge 44. Blade 24 also has a first mount tang 76 having an oval-shaped guide slot 78 formed therethrough. Blade 24 also has a mounting aperture 80 formed proximate trailing portion 40 and a retainer notch 82.

Figure 11:
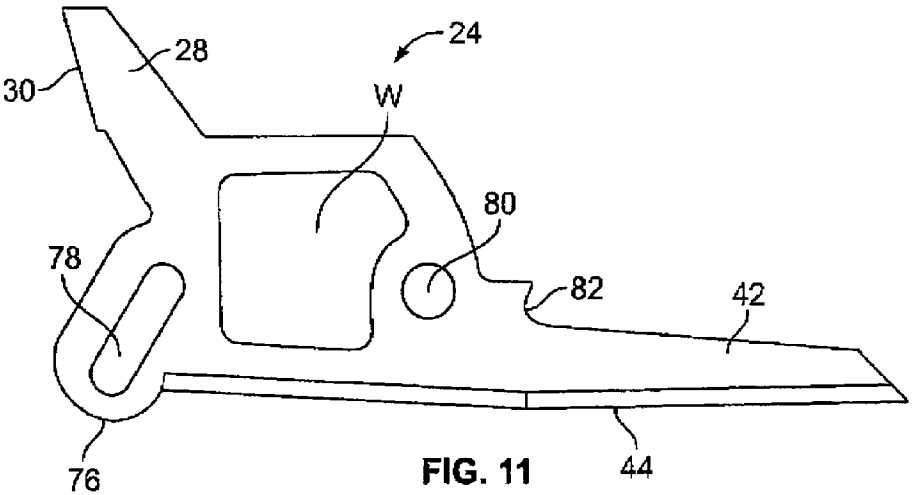
FIG. 11 is a plan view of the blade of FIG. 10.

Referring now to FIG. 11, a plan view of the blade of FIG. 10 is shown, illustrating the relative placement of the foregoing blade elements. A central window W may be formed in blade 24 to reduce the weight of the blade. Weight is a concern, with a broadhead usually weighing 100 grains or less.

Figure 12:
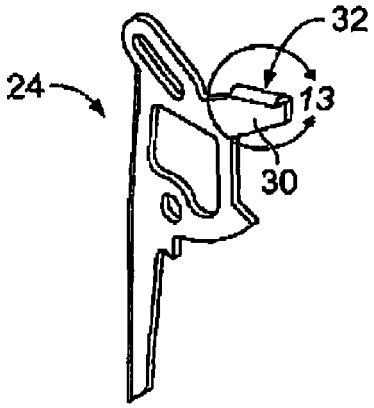
FIG. 12 is a partial perspective view of a broadhead blade with an impact bar.
Figure 13:
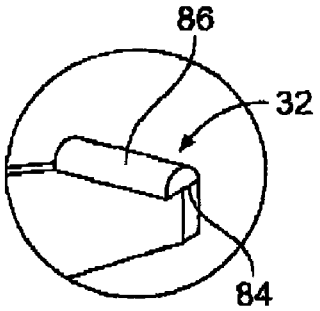
FIG. 13 is an enlarged view of detail A of FIG. 12.

Referring now to FIG. 12, a variation of blade 24 is shown having impact bar 32 attached to lead segment 30. As shown in FIG. 13, impact bar 32 is formed as a hemispherical rod segment having a flat bottom 84 and a curved upper surface 86.

Figure 14:
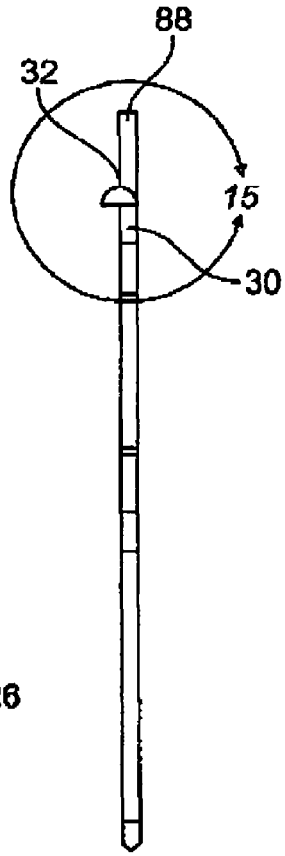
FIG. 14 is a lateral view of the blade of FIG. 12.
Figure 15:
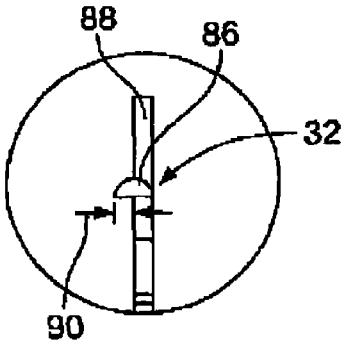
FIG. 15 is an enlarged view of detail C of FIG. 14.

As best seen in FIGS. 14 and 15, impact bar 32 is attached to lead edge 30 such that a portion of impact bar 32 extends past the upper surface 88 of lead portion 28. As seen in FIG. 15, rounded surface 86 is presented toward the target. The offset portion 90 of impact bar 32 may be adjusted to fit the desired aerodynamic characteristics of the broadhead, extending portion 90 past upper surface 88 provides for a larger impact surface area 86.

Figure 16:
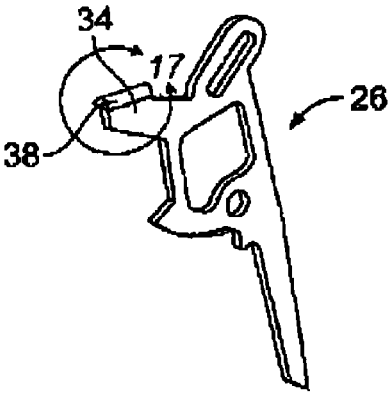
FIG. 16 is a partial perspective view of a broadhead blade showing an alternate attachment for an impact bar.
Figure 17:
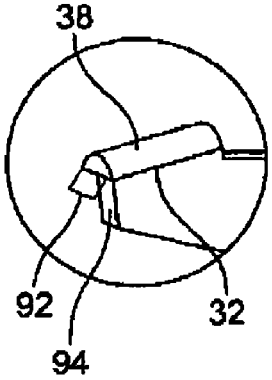
FIG. 17 is an enlarged view of detail B of FIG. 16.

Referring to FIG. 16, right impact bar 38 is shown attached to right lead segment 34 of right blade 26. As seen in FIGS. 16 and 17, impact bar 38 is attached to lead edge 32 such that the offset portion 92 extends past upper surface 94 of blade 26. In this fashion, when the blades are assembled, both impact bars 32 and 38 will have offset 90, 92 facing in the same direction with respect to the blades such that one surface of the blades, in flight, will present a smooth surface with impact bars 32, 38 being flush with one surface of each of the respective blades 24, 26 while the remaining portions of the impact bars 90, 92 will extend downward in the same direction away from blade surfaces 88 and 94, respectively.

Figure 18:
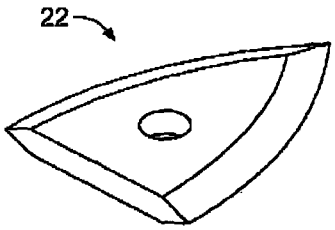
FIG. 18 is a perspective view of a tip blade.
Figure 19:
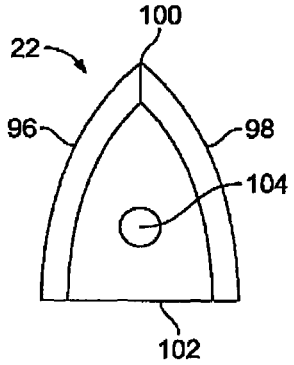
FIG. 19 is a top plan view of the blade of FIG. 18.

Referring now to FIG. 18, a perspective view of tip blade 22 is shown. Referring now to FIG. 19, it can be seen that tip blade 22 is formed in a generally triangular shape with arcuate sharpened edges 96, 98 extending from a tip apex 100 downward to a tip base 102. A mounting aperture 104 is formed through tip blade 22.

Figure 20:
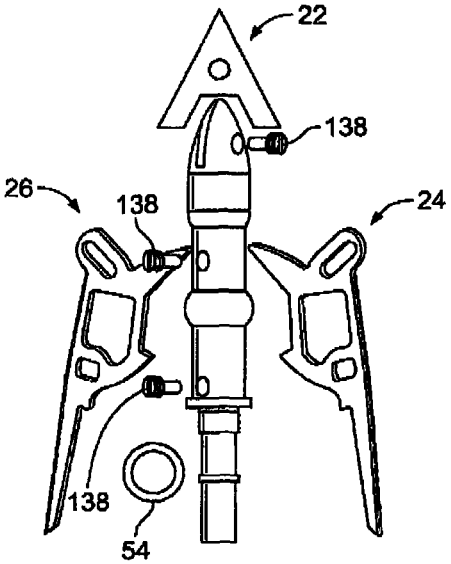
FIG. 20 is an exploded perspective view of a broadhead including the features described herein.

Referring now to FIG. 20 broadhead 10 is shown in an exploded perspective view. As seen, tip blade 22 is shown removed from tip blade slot 60. In like fashion, blades 24, 26 are shown removed from slot 62, and o-ring 54 is shown removed from body 12.

Figure 21:
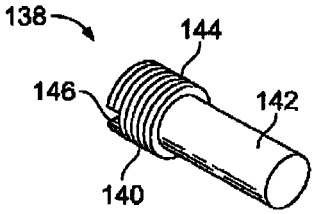
FIG. 21 is a perspective view of a fastener used to assemble the broadhead.
Figure 22:
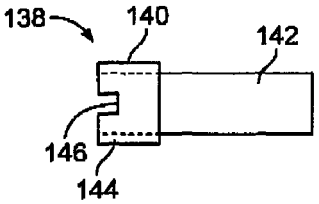
FIG. 22 is a plan view of the fastener of FIG. 21.

Referring now to FIGS. 21 and 22, a preferred form of fastener 138 is shown. In this embodiment, fastener 138 has a head 140 and a shank 142, with head 140 having machine threads 144 formed thereon and shank 142 having a smooth surface. Slot 1465 allows fastener 138 to be turned by a screwdriver. When threaded into bores such as 66, 68, threads 144 engage threaded bore portions 70, 72, while shank 142 presents a smooth surface around which blades 24, 26 can pivot.

Figure 23:
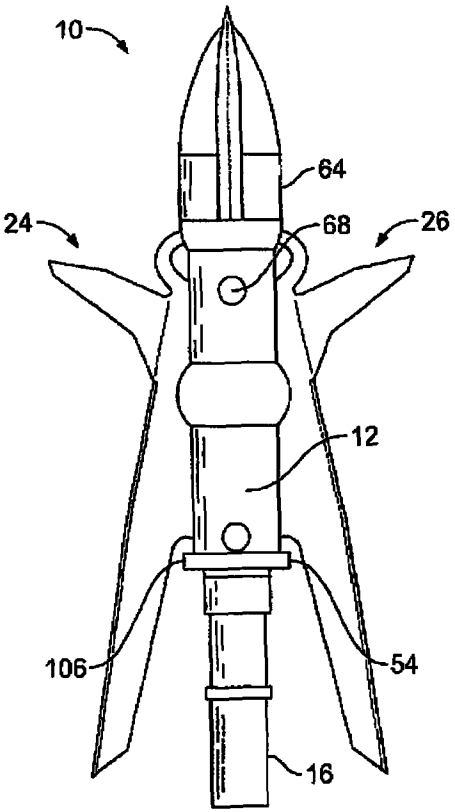
FIG. 23 is a lateral perspective view of an assembled broadhead with the blades in the tucked or flight position.

Referring now to FIG. 23, broadhead 10 is shown assembled, with left and right blades 24, 26 in their "tucked" or flight configuration. As shown, broadhead 10 is not yet attached to an arrow shaft, so threaded mount 16 is exposed. Bore 64 is visible, as is the head of a threaded fastener 138, while bore 68 is not. O-ring 54 is shown, held in place by shoulder 106 formed on body 12.

Figure 24:
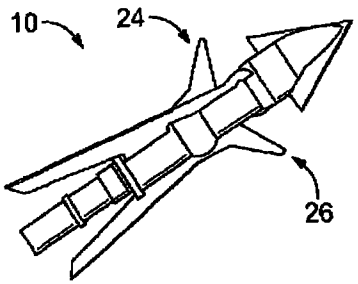
FIG. 24 is a perspective view of the broadhead in flight with the blades in the tucked or flight position.

Referring now to FIG. 24, broadhead 10 is shown as it appears in flight, with blades 24, 26 in their tucked or flight positions.

Figure 25:
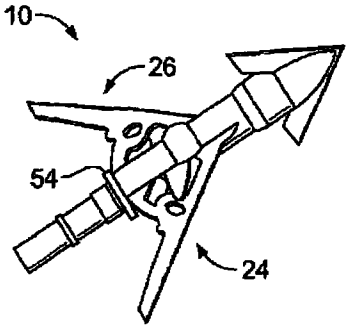
FIG. 25 is a perspective view of the broadhead of FIG. 22 with the blades deployed.

Referring now to FIG. 25, broadhead 10 with blades 24, 26 deployed as they would be after broadhead 10 has struck a target, with blades 24, 26 held in that position by contact with o-ring 54.

Figure 26:
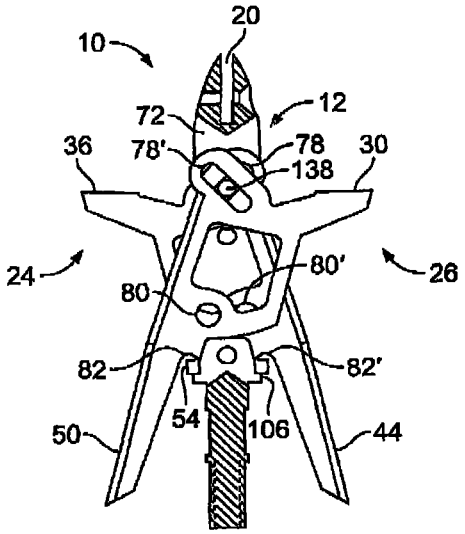
FIG. 26 is a partial sectional view of FIG. 21.

Referring now to FIG. 26 a partial sectional view is shown, with a portion of body 12 removed to illustrate the assembly of blades 24, 26. In this configuration blades 24, 26 are stacked such that the lateral surfaces of blades 24, 26 slide over each other. In this view, the bottom surface of blade 24 rests upon machined surface 72 of blade mount slot 62 and it should be understood that the upper surface of blade 26 is in contact with similar machined surface 76.

It should also be understood that blades 24, 26 are assembled as mirror images of each other and share the same structural configuration.

When in their "tucked" or flight configuration, retainer notches 82, 82' engage o-ring 54 and hold blades 24, 26 in place, and keep sharpened edges 44, 50 in their swept-back position. Fastener 138 is passed through slots 78, 78' and shank 142 provides a pivot surface for blades 24, 26. In a variation of the foregoing, bore 68 can be positioned on body 12 to allow fastener 138 to pass through apertures 80, 80' to prevent blades 24, 26 from deploying, allowing an archer to conduct target practice and determine the flight characteristics of broadhead 10 prior to its striking a target but without deploying the blades, and is an added safety feature keeping the blades from deploying during handling of broadhead 10.

Figure 27:
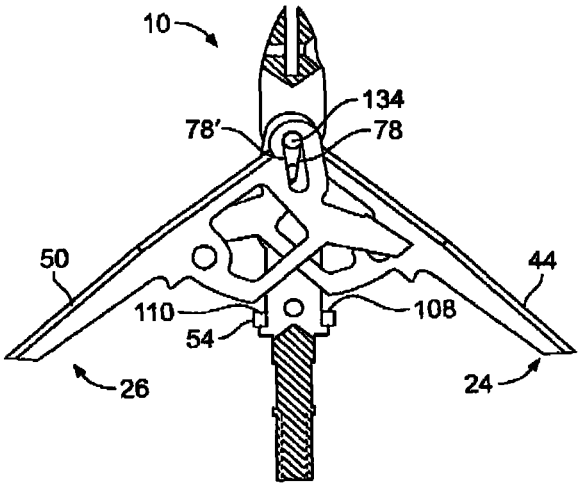
FIG. 27 is a partial sectional view of FIG. 23.

Referring now to FIG. 27, broadhead 10 is shown in its deployed, or after-strike configuration. Blades 24, 26 are expanded outward, with sharpened edges 44, 50 facing forward when having struck the target. When contact with lead edges 34, 36 forces blades 24, 26 to pivot, both are moved rearward along slots 78, 78', constrained by fastener 138, until rear blade edges 108, 110 move into contact with o-ring 54. In this manner, o-ring 54 acts as a stop to keep blades 24, 26 and, thus, sharpened edges 44, 50 held in place with sufficient force to facilitate penetration of the target, while damping the motion of blades 24, 26 as their pivotal and sliding motion comes to an abrupt halt.

Figure 28:
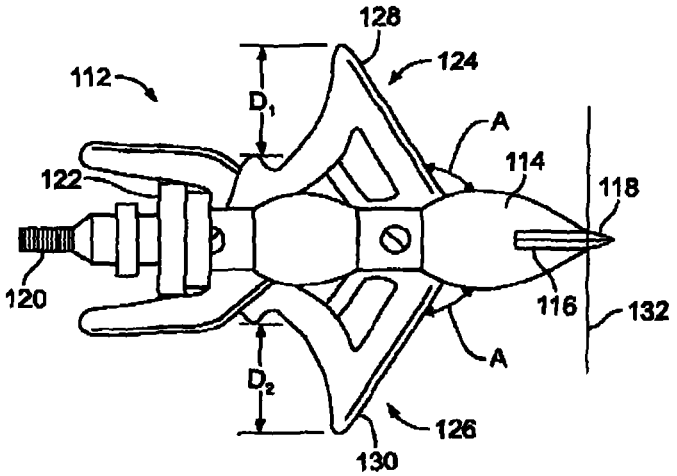
FIG. 28 is a schematic view of a variation of a broadhead with the blades in the tucked or flight position.

Referring now to FIG. 28, a variation of the present invention is disclosed. Broadhead 112 has a body 114, a tip blade slot 116, a tip blade 118, a threaded mounting shaft 120 and an o-ring 122 mounted to body 114. Broadhead 112 also has left and right blades 124, 126 mounted to body 114 substantially as described above with respect to broadhead 10.

In this embodiment. however, blades 124, 126 have a somewhat different configuration. Both are more steeply angled (at angle A) to body 114, and lead portion 128 of blade 124 extends outward a distance $D_1$ from body 114, while lead portion 130 of blade 126 extends an equal distance $D_2$ This presents a larger impact surface for target 132 and one where the increased angle facilitates rapid deployment.

In addition, the relatively large angle A creates a larger moment about the pivots for blades 124, 126, exerting more force over a relatively short distance, pushing sharpened portions 134, 136 to not only deploy more quickly, but with greater cutting force, overcoming some of the momentum lost when an arrow strikes its target and slows as it penetrates.

Figure 29:
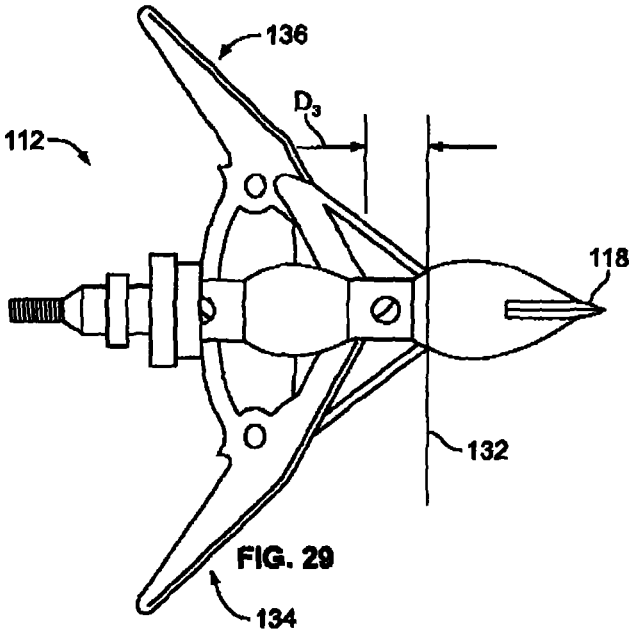
FIG. 29 is a schematic view of the broadhead of FIG. 24 with the blades in the expanded position.

As seen in FIG. 29, it is expected that this configuration will cause sharpened portions 134, 136 of blades 124, 126 to deploy further in advance of contact with target 132 by distance $D_3$. This allows tip 118 to penetrate deeper before blades 124, 126 deploy, for those applications where deeper penetration is an advantage for hunting certain types of game. In this configuration broadhead 112 exhibits characteristics similar to those of fixed-blade broadheads.

The foregoing disclosed embodiments provide cuts of up to about 2⅜ inches, believed to be larger than those created by existing broadheads. Manufacturing the broadhead components from highly machined and polished metal provides for a lightweight arrowhead with flight characteristics contributing to stable, accurate and predictable flight, and more humane kills.

This is achieved while still presenting a head configuration that successfully attains accurate flight. Changing broadheads for different hunting applications is facilitated by the universal-type screw mount utilized to mount broadhead 10 to an arrow shaft.

What is claimed is:

1. A broadhead mountable to an arrow shaft for striking a target, said broadhead comprising:

a longitudinally extending body having a distal end and a proximal end;

means for cutting said target upon impact, said cutting means positioned at said distal end;

means for mounting said broadhead to said arrow shaft, said mounting means positioned at said proximal end;

said body having a longitudinally-extending slot;

two extendable blades, each said blade pivotally retained within said slot, each said blade moveable between a first, tucked position and a second, extended position, each said blade having a cutting edge, each said blade disposed substantially within said slot when said blade is in said tucked position, said cutting edge being exposed to said target when said blade is in said extended position;

each said blade having a lead segment, each said lead segment disposed at an angle greater than 90' with respect to said body when said blade is in said tucked position, each said lead segment being shaped and positioned to contact said target when said blade is in said tucked position, thereby moving each said lead segment into said slot and moving said cutting edges into position to contact said target whereby said contact results in a cut larger than the cut made by said cutting means; and wherein at least one said lead edge further comprises an impact bar, said impact bar having a cross-sectional area larger than that of said lead edge.

2. The broadhead as recited in claim 1 wherein said broadhead further comprises means for retaining said blades in said tucked position.

3. The broadhead as recited in claim 2 wherein said retaining means holds said blades in frictional engagement.

4. The broadhead as recited in claim 3 wherein said retaining means comprises an o-ring attached to said body.

5. The broadhead as recited in claim 1 wherein said broadhead further comprises means to engage and hold said blades in said extended position after said broadhead strikes said target.

6. The broadhead as recited in claim 5 wherein said retaining means holds said blades in frictional engagement.

7. The broadhead as recited in claim 6 wherein said retaining means comprises an o-ring attached to said body.

8. The broadhead as recited in claim 1 wherein said broadhead further comprises means for retaining said blades in said tucked position and means to engage and hold said blades in said extended position after said broadhead strikes said target, said retaining means and said engagement means comprising an o-ring engaging said blades in a friction fit, said o-ring mounted to said body.

9. The broadhead as recited in claim 1 wherein said blades are configured to deploy after said cutting means penetrates said target.

10. The broadhead as recited in claim 1 wherein each said lead edge is positioned intermediate said cutting means and one said cutting edge.

11. A broadhead mountable to an arrow shaft for striking a target, said broadhead comprising:

a longitudinally extending body having a distal end and a proximal end;

means for cutting said target upon impact, said cutting means positioned at said distal end;

means for mounting said broadhead to said arrow shaft, said mounting means positioned at said proximal end;

said body having a longitudinally-extending slot;

two extendable blades, each said blade pivotally retained within said slot, each said blade moveable between a first, tucked position and a second, extended position, each said blade having a cutting edge, each said blade disposed substantially within said slot when said blade is in said tucked position, said cutting edge being exposed to said target when said blade is in said extended position;

each said blade having a lead segment, each said lead segment being shaped and positioned to contact said target when said blade is in said tucked position, contacts said target, thereby moving each said lead segment into said slot and moving said cutting edges into position to contact said target whereby said contact results in a cut larger than the cut made by said cutting means; and at least one said lead edge further comprising an impact bar, said impact bar having a cross-sectional area larger than that of said lead segment, each said lead segment being shaped and positioned to contact said target when said blade is in said tucked position, contacts said target, thereby moving each said lead segment into said slot and moving said cutting edges into position to contact said target whereby said contact results in a cut larger than the cut made by said cutting means.

* * * * *